United States Patent [19]

Frische

[11] 4,098,932

[45] Jul. 4, 1978

[54] ULTRA HIGH SPEED BOTTLE COATING PROCESS

[75] Inventor: Dale George Frische, Belleville, Ill.

[73] Assignee: Indian Head Inc., New York, N.Y.

[21] Appl. No.: 788,337

[22] Filed: Apr. 18, 1977

Related U.S. Application Data

[60] Continuation of Ser. No. 579,776, May 22, 1975, abandoned, which is a division of Ser. No. 453,829, Mar. 22, 1974, Pat. No. 3,902,453.

[51] Int. Cl.[2] ..... B05D 1/02

[52] U.S. Cl. ..... 427/374 R; 427/379; 427/401; 427/402; 427/425

[58] Field of Search ..... 427/27, 425, 374 R, 427/402, 379, 401, 407 A, 33; 118/322, 503; 198/344, 379, 22 B, 179, 240–243; 65/60; 156/567, DIG. 13, 26

[56] References Cited

U.S. PATENT DOCUMENTS

| | | | |
|---|---|---|---|
| 2,334,087 | 11/1943 | Goebel et al. | 427/425 X |
| 3,031,367 | 4/1962 | Ehlenbeck | 156/DIG. 13 |
| 3,362,520 | 1/1968 | Rudolph et al. | 198/243 |
| 3,765,856 | 10/1973 | Bowman | 65/60 |
| 3,855,966 | 12/1974 | Panas | 118/503 |
| 3,860,104 | 1/1975 | Strauss | 198/240 |

*Primary Examiner*—Harry J. Gwinnell
*Assistant Examiner*—Stuart D. Frenkel
*Attorney, Agent, or Firm*—Brumbaugh, Graves, Donohue & Raymond

[57] ABSTRACT

An ultra high speed bottle coating system and process utilizes an overhead chuck conveyor in conjunction with a bottle bottom stabilizing conveyor for the rapid transport and stabilization of a suspended file of bottles through at least one spray coat station having a bottle rotator therein.

2 Claims, 11 Drawing Figures

FIG. 9
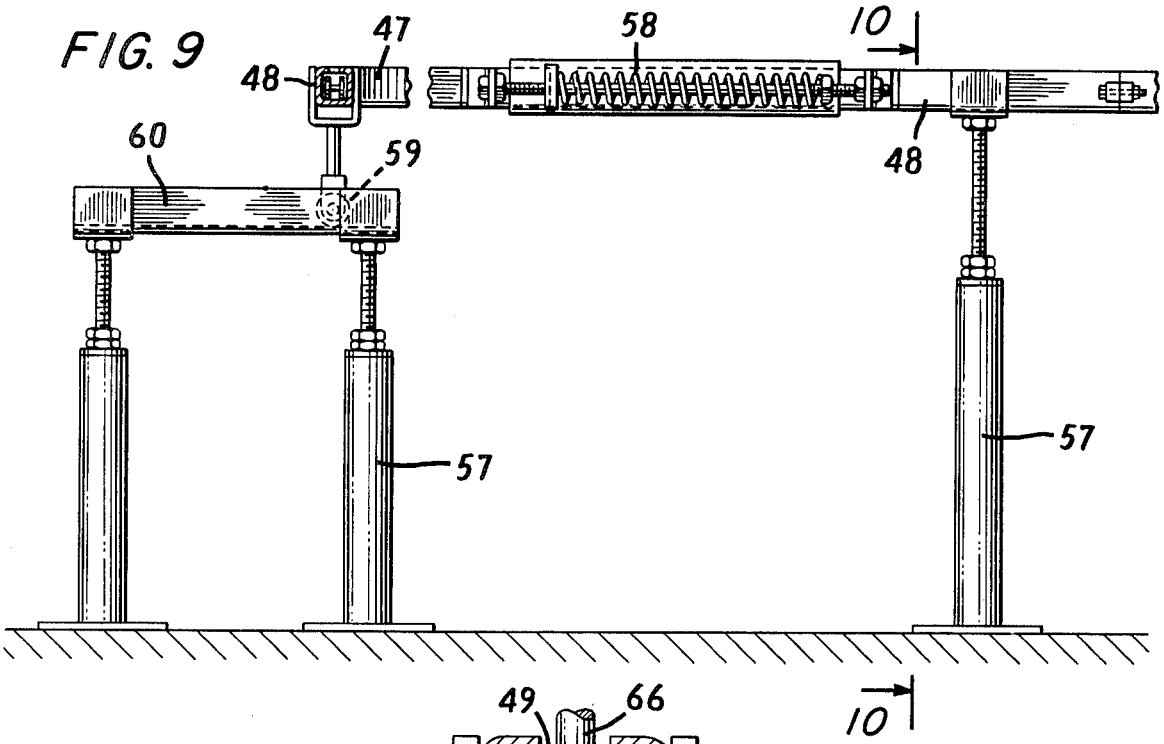
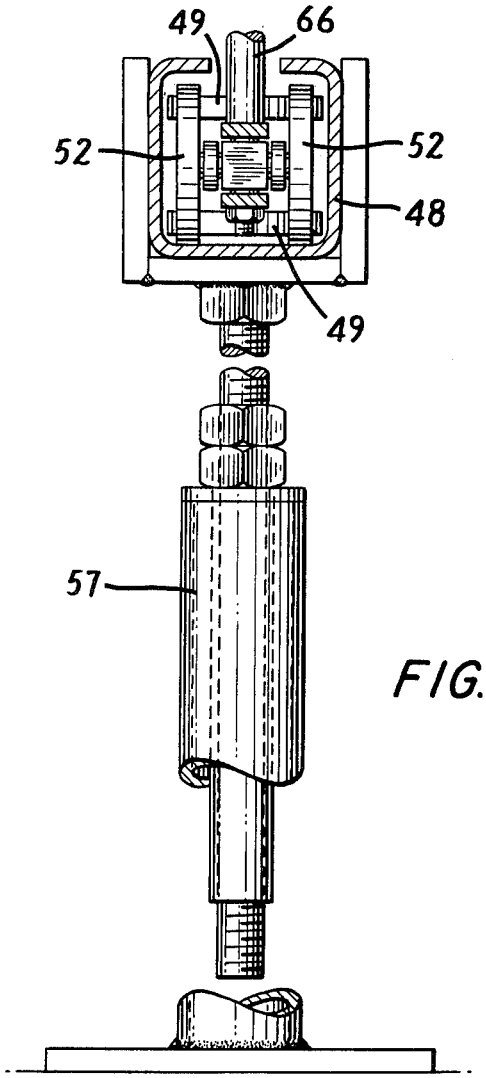
FIG. 10

ULTRA HIGH SPEED BOTTLE COATING PROCESS

This application is a continuation application of U.S. application Ser. No. 579,776, filed May 22, 1975 (now abandoned), which U.S. application Ser. No. 579,776 is a divisional application of U.S. application Ser. No. 453,829, filed Mar. 22, 1974 (now U.S. Pat. No. 3,902,453).

The present invention relates to an ultra high speed bottle coating system and process.

In my copending U.S. application Ser. No. 404,034, filed Oct. 5, 1973, the disclosure of which is hereby incorporated by reference herein, there is disclosed a high speed bottle coating system and process which comprises among its elements an overhead chuck conveyor for rapid transporting of a file of suspended bottles through one or more spray coat stations having within the stations means for rotating or spinning the suspended bottles while they are being spray coated so as to insure a uniform coating therearound. In my copending U.S. application Ser. No. 432,188, filed Jan. 10, 1974, (now U.S. Pat. No. 3,889,800) the disclosure of which is hereby incorporated by reference herein, there is disclosed a bottle chuck having a snap-on snap-off coupling which is particularly useful as the bottle chuck element of the overhead chuck conveyor of the aforesaid application and the present application; in my copending U.S. application Ser. No. 413,921, filed Nov. 8, 1973, (now U.S. Pat. No. 3,858,716) the disclosure of which is hereby incorporated by reference herein, there is disclosed a spinner or rotator assembly mechanism which is particularly useful as the rotator element in the spray coat stations of the same aforesaid application and of the present application; while in my copending U.S. application Ser. No. 453,828, filed Mar. 22, 1974 (now U.S. Pat. No. 3,869,249), the disclosure of which is hereby incorporated by reference herein, there is disclosed a curing oven which is particularly useful as the curing oven element of the same aforesaid application and of the present application.

The high speed bottle coating system disclosed in my copending U.S. application Ser. No. 404,034 comprises, in general, a sequential synchronized array of a bottle unpacking station, a single file bottle belt conveyor, an overhead chuck conveyor bottle loading station, at least one suspended bottle rotating and spray coat station, a bottle bottom dryer, an overhead chuck conveyor bottle unloading station, a single file bottle belt conveyor, a multi-file bottle stacking station, a curing oven having heating and cooling sections and a bottle packing station. In one of the variations or embodiments of that system, the suspended bottle rotating and spray coat station comprises a bottle rotating and prime coat spray booth, a prime coat dryer and at least one bottle rotating and top coat spray station. In another variation or embodiment of that system, the bottom rotating and top coat spray station comprises first and second bottle rotating and top coat spray booths. In a further variation or embodiment of that system, one of the bottle rotating and top coat spray booths has both forward and reverse bottle rotators.

The high speed bottle coating process of my copending U.S. application Ser. No. 404,034 comprises, in general, unpacking the bottles, conveying single file bottles in an upright position to a bottle loading station, loading the bottles by their finish onto an overhead chuck conveyor, rotating and spray coating the suspended bottles at least once, drying the coated bottle bottoms, unloading the coated bottles from the overhead chuck conveyor, conveying the single file coated bottles in an upright position to a multi-file bottle stacker, stacking the coated bottles in multi-files, curing and cooling the coated bottles, and packing the coated bottles. In one of the variations or embodiments of that process, the bottles are rotated and spray coated by rotating and spray prime coating them, drying the prime coated bottles, and rotating and spray top coating the dried prime coated bottles. In other variations or embodiments of that process, the bottles are rotated and spray top coated twice, preferably with the bottles being both forwardly and reversely rotated during one of the two bottles rotating and spray top coating steps.

That high speed bottle coating system is capable of operating at a high speed such that 45-55 bottles per minute can be coated. However, if that system is operated at a higher speed, then there is a tendency for the suspended bottles held by their finish in the bottle chucks of the overhead chuck conveyor to wobble. As a consequence, when the bottles are spray top coated twice with a coating in the upper portion which is different in color from the coating in the lower portion, there is then an undesirable irregular line of demarcation between the top coats. Moreover, when that system is operated at a higher speed there is also a tendency for the suspended bottles to fall free from the bottle chucks of the overhead chuck conveyor, particularly during their rotation, resulting in costly bottle breakage and decreased throughout or bottle coating production.

It is, therefore, the principal object of the present invention to improve that high speed bottle coating system and process so as to provide an ultra high speed bottle coating system and process capable of operating at an ultra high speed such that 90-100 bottles per minute or more can be spray coated without wobble of the suspended bottles during the spray coating operation and without appreciable bottle breakage.

In accordance with the present invention, the above-described high speed bottle coating system is improved in that the at least one suspended bottle rotating and spray coat station has a bottle bottom stabilizing conveyor with bottle bottom dimple engageable pivot pins in synchronized parallel alignment and registration with bottle chucks of the overhead chuck conveyor.

There are several variations or embodiments of the ultra high speed bottle coating system of the present invention. Thus in one of the variations or embodiments, the bottle bottom stabilizing conveyor has as ascending track section adjacent the entry to the suspended bottle rotating and spray coat station for bringing the pivot pins into engagement with the bottle bottom dimples and has a descending track section adjacent the exit from the suspended bottle rotating and spray coat station for bringing the pivot pins out of engagement with the bottle bottom dimples. In another variation or embodiment, each pivot pin is spring-loaded and has a notch in its face and the descending track section has an inclined overhead bar in depression engagement with the notch of each spring-loaded pivot pin for depressing the pivot pins away from the bottle bottom dimples. In a further variation or embodiment, each pivot pin has snap-on snap-off means for connecting it to a belt of the bottle bottom stabilizing conveyor.

The ultra high speed bottle coating process of the present invention is an improvement upon the high speed bottle coating process described above in that it further comprises rotating and spray coating the suspended bottles at least once while engaging the bottle bottom dimples with stabilizing pivot pins.

BRIEF DESCRIPTION OF THE DRAWINGS

The improved system and process of the present invention will be more specifically described in connection with the accompanying drawings wherein:

FIG. 9 is a front elevational sectional view taken on section line 9—9 of FIG. 8 of the spring take-up and support legs of the bottle bottom stabilizing conveyor, and FIG. 10 is an elevational sectional view taken on section line 10—10 of FIG. 9 of an adjustable support leg for the bottle bottom stabilizing conveyor.

DETAILED DESCRIPTION

Figure 1:
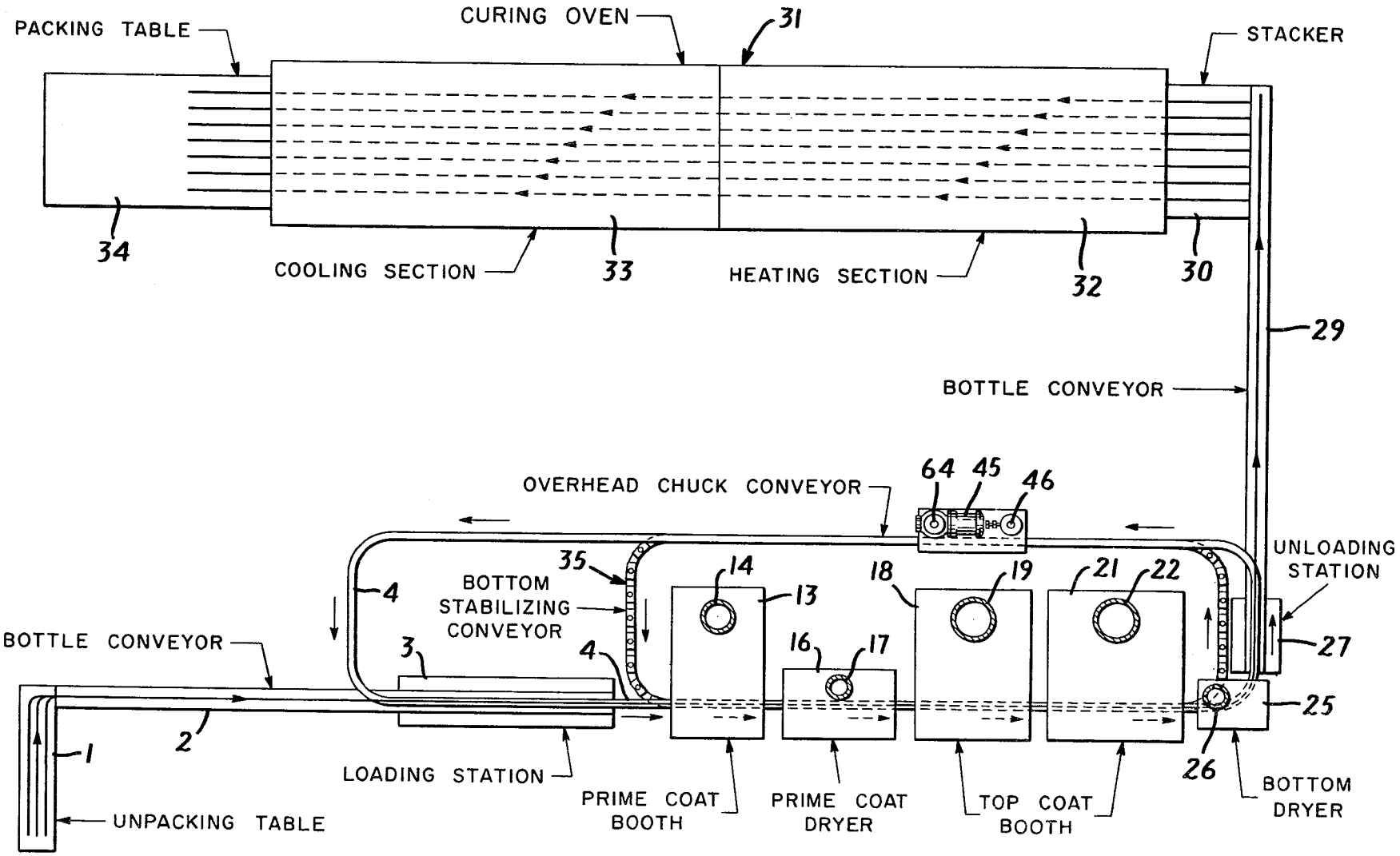
FIG. 1 is a diagrammatic plan view of the preferred improved system of the invention.

The preferred ultra high speed bottle coating system of the invention illustrated by FIGS. 1-10 of the drawings will be described in conjunction with the preferred ultra high speed bottle coating process of the invention for simplicity of presentation and ease of understanding. There will first be described the high speed bottle coating system and process of my copending U.S. application Ser. No. 404,034 which are improved by the ultra high speed bottle coating system and process of the present invention with particular reference being made to FIGS. 1 and 2 of this application and to FIGS. 1-4 of that copending application which have been incorporated by reference herein.

Cartons of bottles, such as a jug with a handle, are unloaded manually in an upright position from their cartons onto an unpacking table 1, which is a wide metal belt conveyor. The bottles are fed along the unpacking table in multi-files to a directional arm at the end of the table which orients or directs the bottles in single file. The bottles in single file are fed to a bottle belt conveyor 2 along which they travel to a loading station 3. The bottle belt conveyor 2 meets in alignment at the loading station 3 with and directly beneath an overhead chuck conveyor 4. The speed of the bottle belt conveyor 2 and the spacing between the finish or neck of consecutive touching bottles therealong are synchonized with the speed of the overhead chuck conveyor 4 and the spacing between consecutive chucks 5 therealong.

The overhead chuck conveyor 4 comprises a plurality of chucks 5 separated from one another by spacers. Each chuck 5 comprises two vertical supporting shafts 6 with opposed rollers 7. Extending downwardly from the supporting shafts 6 and operatively connected to the rollers 7 is a vertically retractable rod 8 having fixed thereon a rotatable collar 9 which encloses chuck fingers 10.

At the loading station 3 the rollers 7 of the chuck 5 engage upwardly inclined track fingers 11 which raise the retractable rod 8 and collar 9 and thereby open the chuck fingers 10.

The bottle conveyor 2, which is vertically adjustable, is upwardly inclined at the loading station 3 and aligned beneath the horizontal overhead chuck conveyor 4 so that the finish or neck of each bottle engages the opened chuck fingers 10 of a chuck 5 toward the far end of the bottle conveyor 2. At the far end of the bottle conveyor 2 within the loading station 3 the chuck rollers 7 move along downwardly inclined track fingers 12. This movement lowers the retractable rod 8 and collar 9 and thereby closes the chuck fingers 10 into gripping engagement with the finish or neck of a bottle.

The bottles, now suspended from the overhead chuck conveyor 4, travel to a prime coat spray booth 13 having an exhaust stack 14.

Figure 2A:
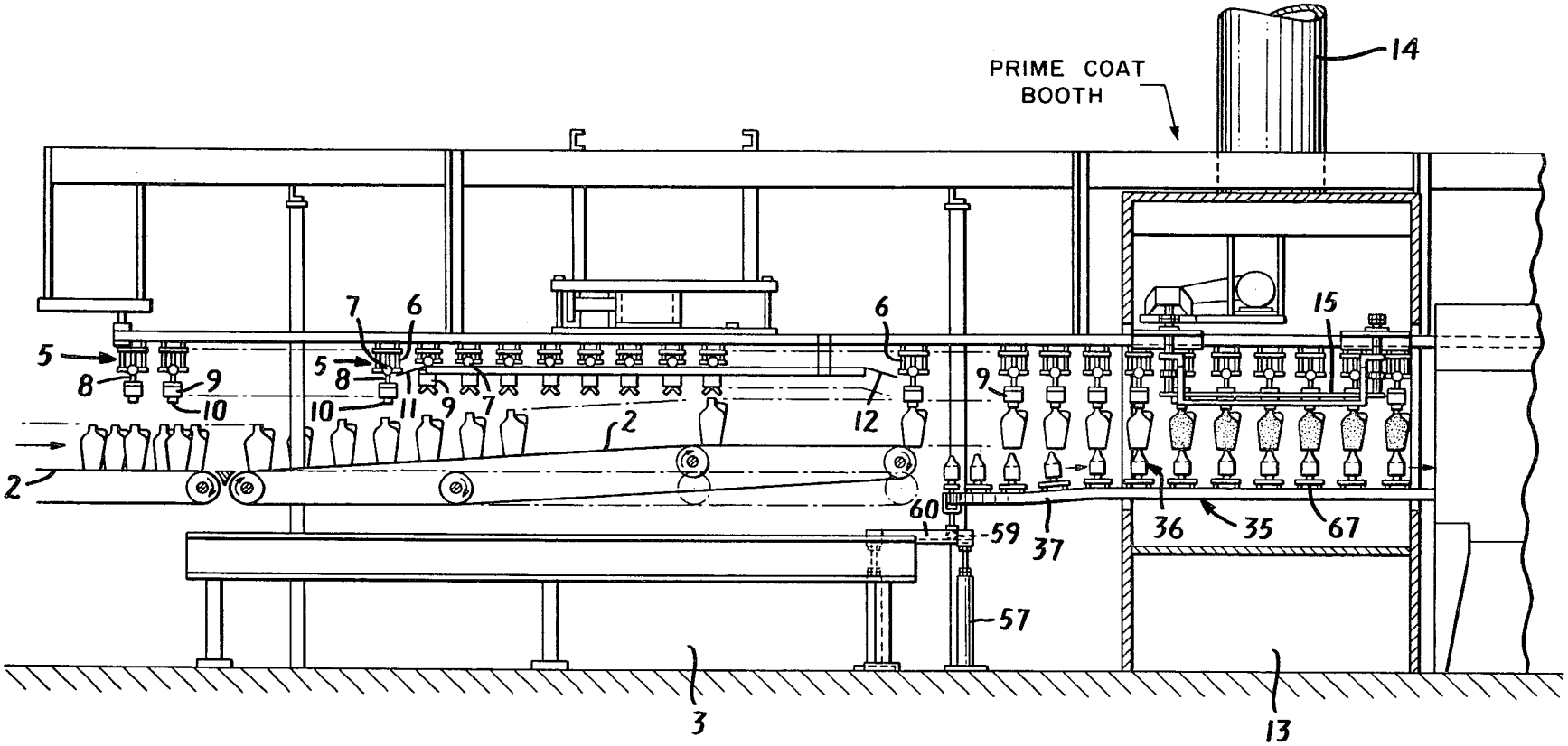
FIGS. 2A and 2B represent a diagrammatic front elevational view of the preferred improved system of the invention (it being understood that the diagrammatic end elevational view and the diagrammatic rear elevational view of the preferred improved system of the present invention are the same as in FIGS. 3 and 4 of my copending U.S. application Ser. No. 404,034)
Figure 2B:
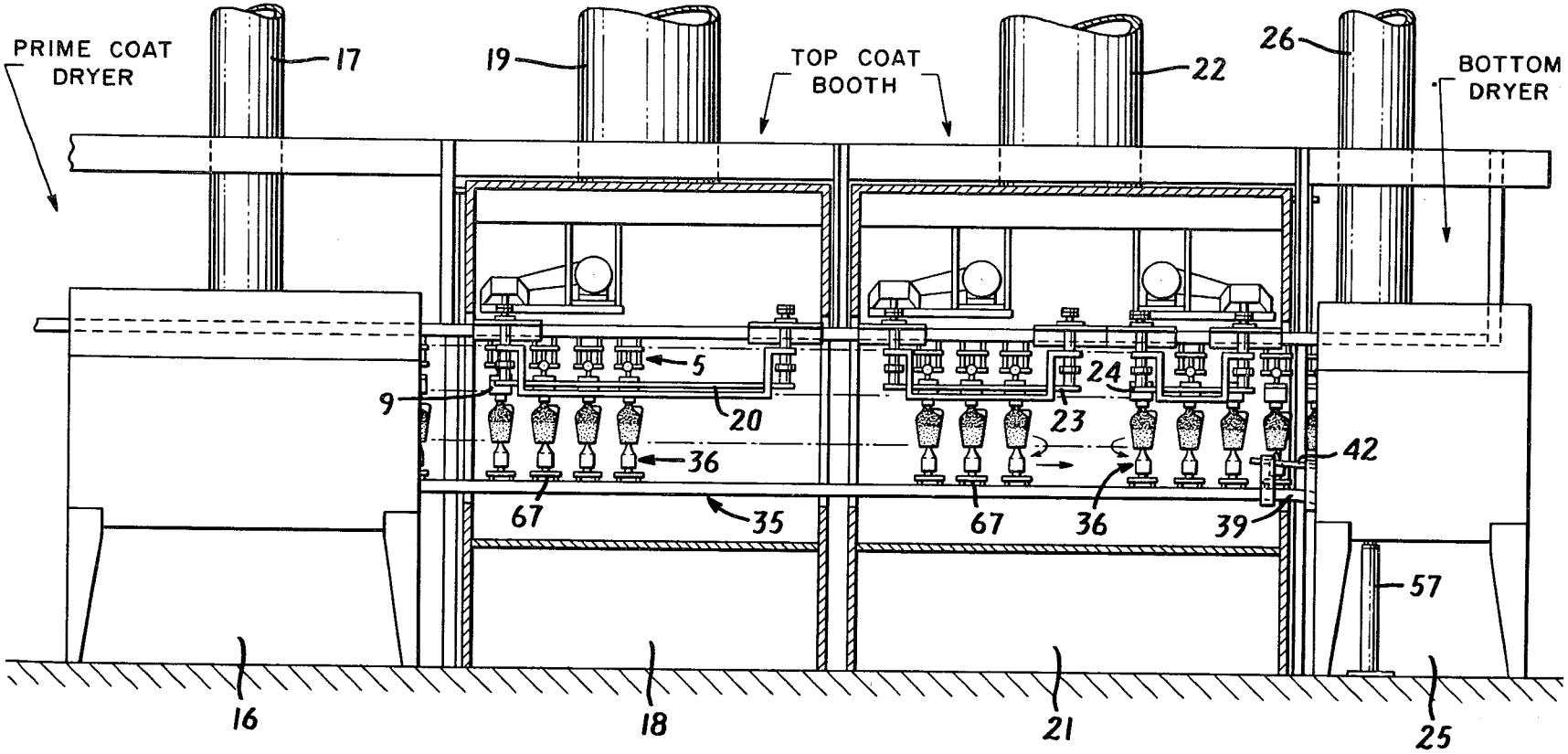
Figure 3:
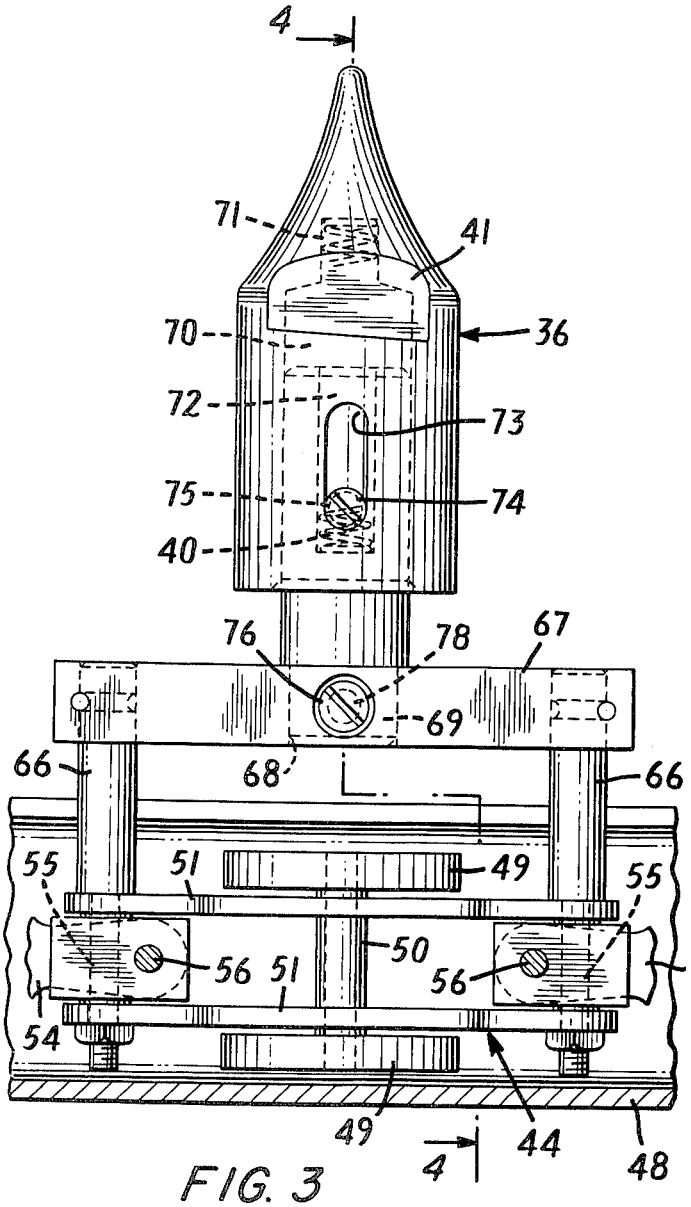
FIG. 3 is a front elevational sectional view taken on section line 3—3 of FIG. 5 of an articulated unit of the bottle bottom stabilizing conveyor with a bottle bottom dimple engageable pivot pin.
Figure 4:
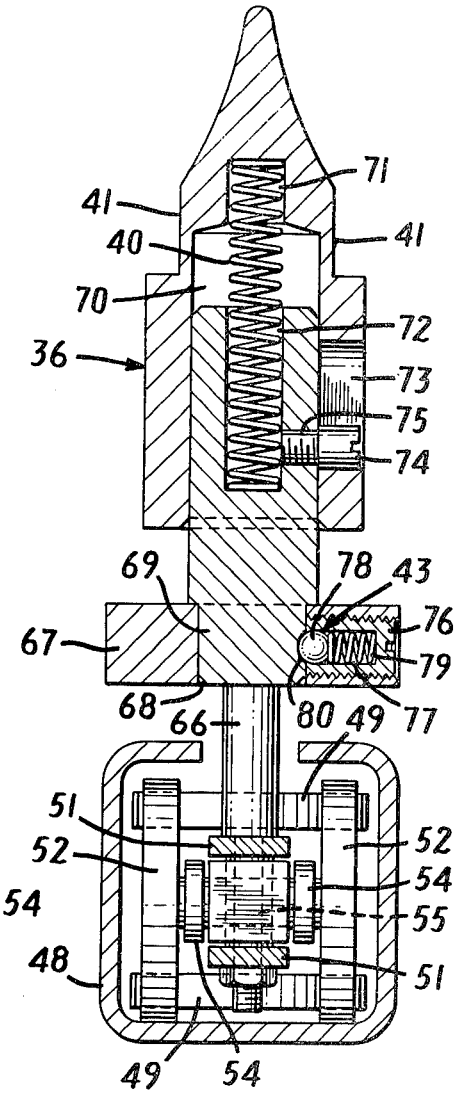
FIG. 4 is an end elevational sectional view taken on section line 4—4 of FIG. 3.
Figure 5:
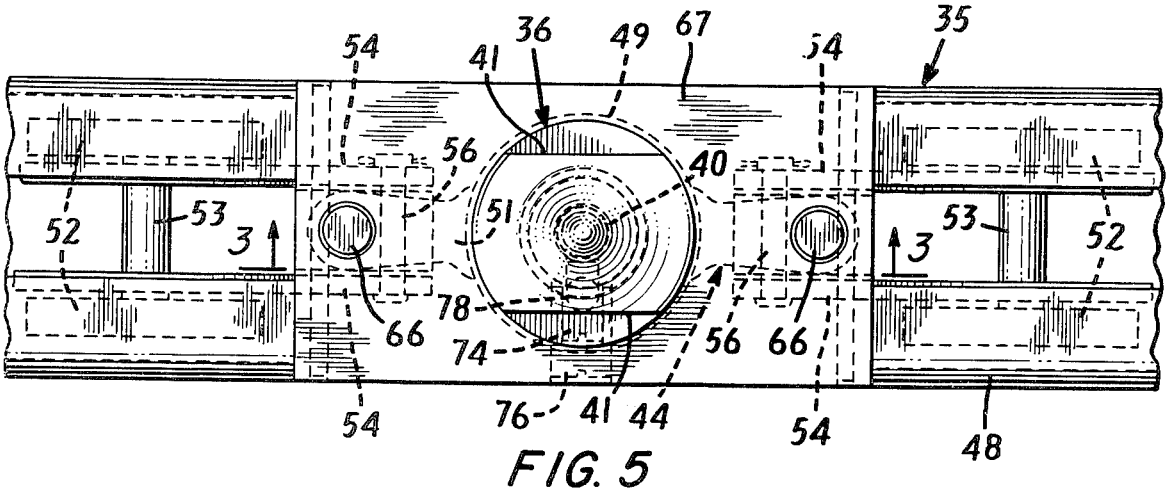
FIG. 5 is a top plan view of a representative portion of the bottle bottom stabilizing conveyor.
Figures 6, 7:
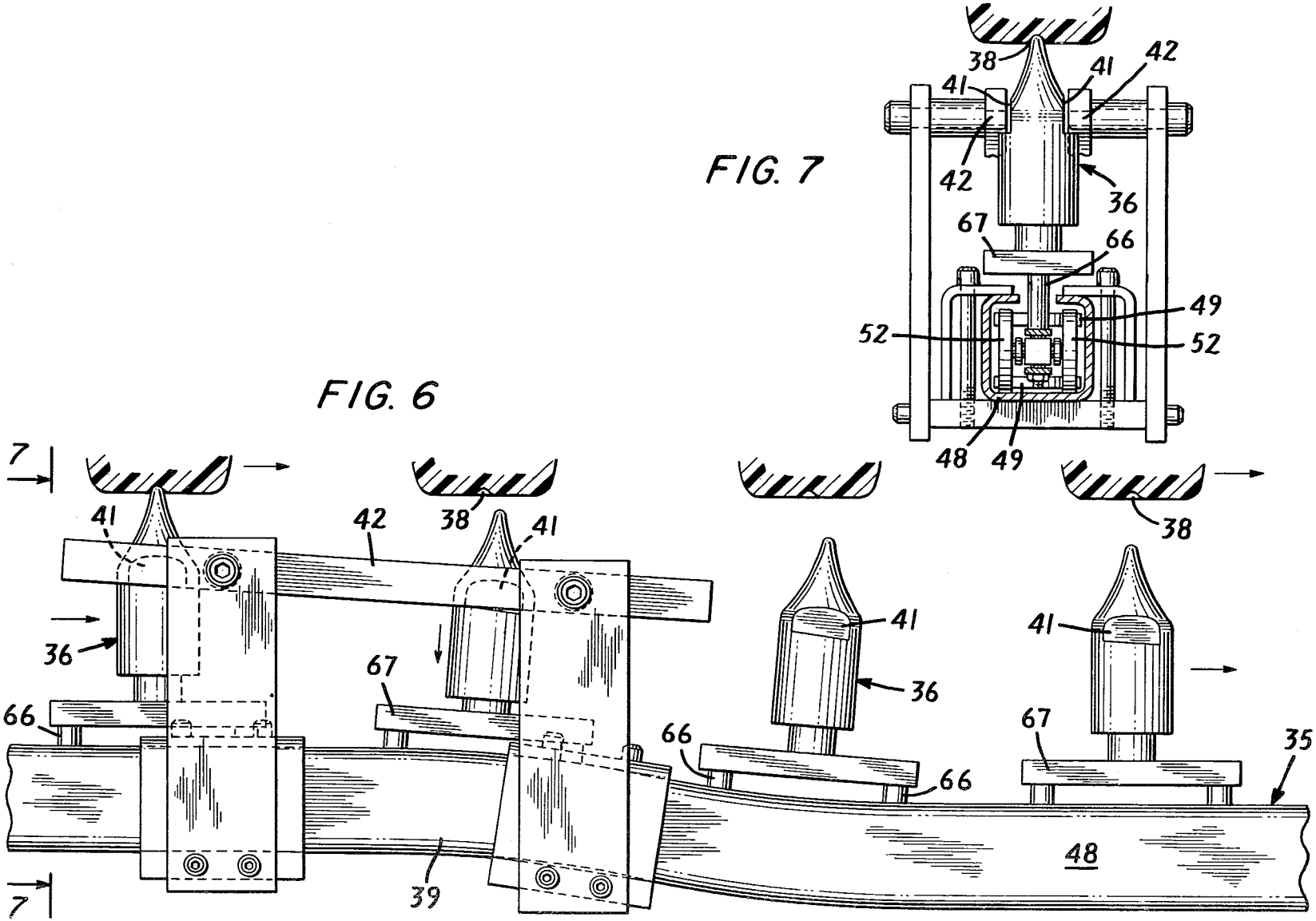
FIG. 6 is a front elevational view of the descending track section of the bottle bottom stabilizing conveyor.
FIG. 7 is an end elevational sectional view taken on section line 7—7 of FIG. 6.
Figure 8:
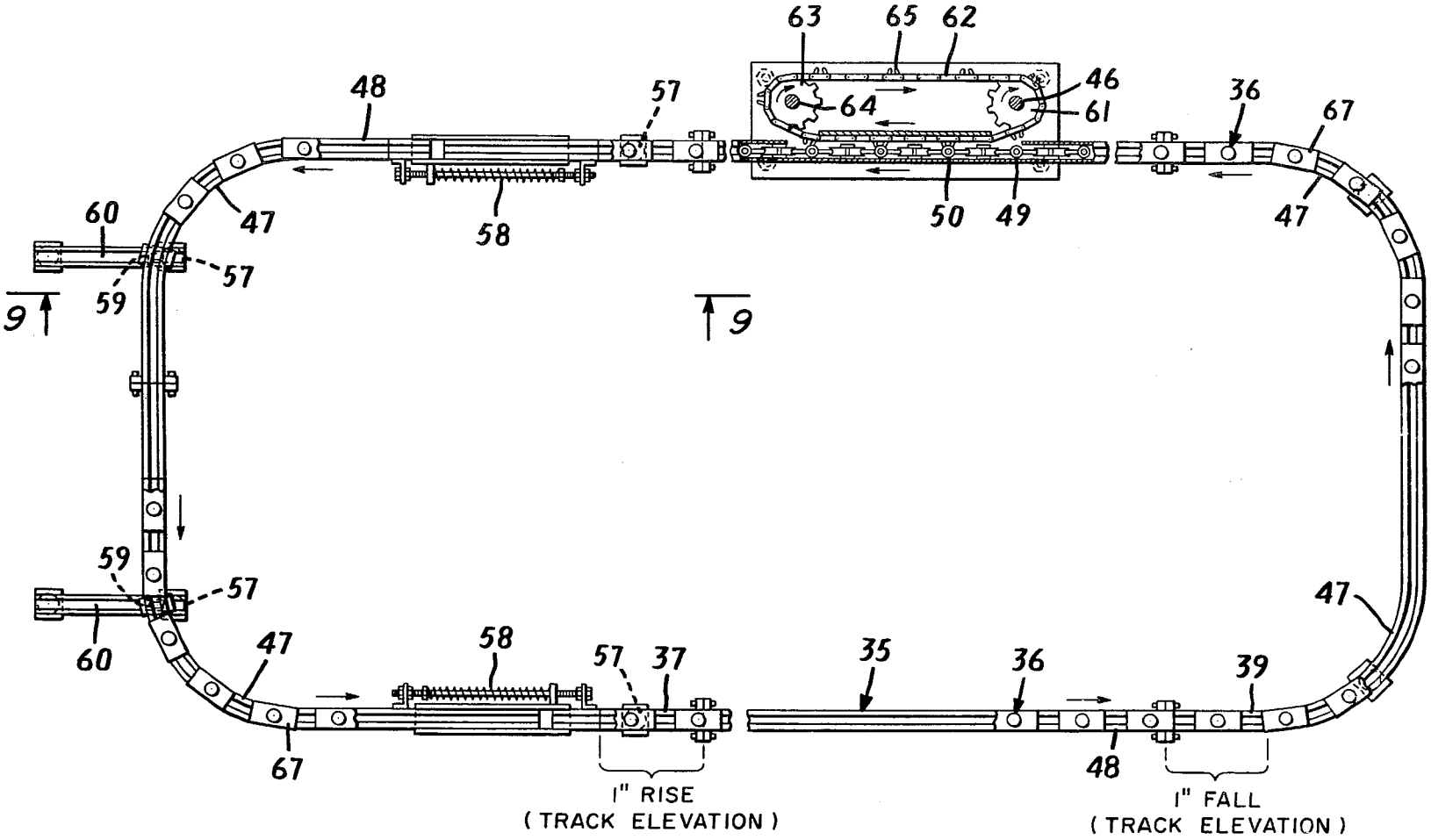
FIG. 8 is a top plan view of the bottle bottom stabilizing conveyor.

In the foreground of FIGS. 1 and 2 and facing the prime coat spray booth 13 there are mounted reciprocating spray guns (not shown) connected to a drum (not shown) containing a prime coating composition. In the prime coat spray booth 13 the bottles are sprayed with the prime coating composition while the bottles are rotated so as to apply the prime coating uniformly along all sides and the bottom of each bottle. Rotation of each bottle is achieved by rotating the collar 9 of the chuck 5 by engagement with a drive belt 15 which will rotate the bottles either clockwise or counterclockwise depending upon the linear direction of movement of the belt 15.

The bottles are transported by the overhead chuck conveyor 4 from the prime coat spray booth 13 to a prime coat dryer 16 having an exhaust stack 17 and equipped with heating lamps or elements (not shown). In the prime coat dryer 16, the prime coat is dried to an extent sufficient to receive a top coat.

The prime coated bottles leave the prime coat dryer 16 and enter a first top coat spray booth 18 having an exhaust stack 19. The top coat spray booth 18 has in the foreground of FIGS. 1 and 2 reciprocating spray guns (not shown) connected to a drum (not shown) containing a top coating composition, e.g., grey paint. As the top coating composition is sprayed on the bottles, the bottles are rotated, either clockwise or counterclockwise, by engagement of the chuck collars 9 with a drive belt 20 so that the top coating can be uniformly applied to that portion of the bottles at which the spray guns are directed, such as the bottoms and the lower portion of the sidewalls.

The train of overhead suspended bottles passes from the first top coat spray booth 18 into a second top coat spray booth 21 having an exhaust stack 22. In the foreground of FIGS. 1 and 2 there are mounted reciprocating spray guns (not shown) connected to a drum (not shown) containing a top coating composition, e.g., brown paint. Such guns can be directed at the upper portion of the sidewalls of the bottles and their handles to as to apply uniformly a top coating of a color which can be different from that applied to the bottom and lower portion of the bottles in the first top coat spray booth 18.

As the top coat is applied to the bottles within the second top coat spray booth 21, the bottles are rotated in one direction, for example, clockwise, by engagement of the chuck collars 9 with a drive belt 23 and are then rotated in the opposite direction, for example, counterclockwise, by engagement of the chuck collars 9 with a drive belt 24 moving in the opposite linear direction from that of drive belt 23. Thus the bottles are given a forward and reverse rotation by the oppositely moving drive belts 23 and 24. Such forward and reverse rotation of the bottles enables all portions of the open handle of a jug handle bottle to have a top coat uniformly applied thereto.

The overhead chuck conveyor 4 carries the train of suspended bottles from the second top coat spray booth 21 through a bottle bottom dryer 25 having an exhaust stack 26. Therein the bottoms of the coated bottles are dried to a nontacky state by passing over top of a heating element, such as a calrod heating coil (not shown).

The train of bottles passes from the bottle bottom dryer 25 into an unloading station 27 which is the structural and operational reverse of the loading station 3. Thus at the unloading station 27, the collar 9 of the chucks 5 is retracted vertically by passage of the rollers 7 up inclined track fingers 28 (See FIG. 3 of my copending U.S. application Ser. No. 404,034) and thereby opening the chuck fingers 10 to deposit the bottles in an upright position upon a downwardly inclined single file bottle belt conveyor 29. In view of the fact that the bottle bottoms have been previously dried to a nontacky state in the bottom bottle dryer 25, the coating on the bottoms of the bottles is not unduly marred by depositing the bottles upon the bottle belt conveyor 29.

The bottles are conveyed in single file by the bottle belt conveyor 29 to a multi-file bottle stacking station 30. Here the single file of bottles is stacked manually or mechanically, for example, by a gang stacker, into multi-files on a wide metallic conveyor belt.

The multi-file of bottles is conveyed by the belt through an elongated curing oven 31 having a heating section 32 and a cooling section 33. In the curing oven 31, the coating on the bottles is dried and cured, e.g., at 450°–600° F. for 15–15 minutes, respectively, by forced hot air convention in the heating section 32 and then cooled down to a temperature at which they can be manually handled in a still or forced air cooling section 33.

The bottles exit from the curing oven 31 onto a packing table 34 where they are manually packed into shipping cartons.

In the variations of the foregoing described system and process, the prime coat dryer 16 and the first and second top coat spray booths 18 and 21 can be omitted where desired, and the prime coat spray booth 13 then used for applying a single coat to bottles in those instances where both a prime coat and one or more top coats are either unnecessary or undesired. In those instances where only a single top coat is necessary or desired, only the second top coat spray booth 21 can be omitted. Moreover, the forward and reverse bottle rotator belts 23 and 24 in the second top coat spray booth 21 could just as well be located in the first top coat spray booth 18. Also in those instances where bottles are coated which do not have an open handle, the second top coat spray booth 21 need have only a single or unidirectional bottle rotator.

There will now be described the preferred embodiment of the improvement of the present invention upon the foregoing described system and process.

The improvement in the system comprises the prime coat spray booth 13, the prime coat dryer 16, the first top coat spray booth 18 and the second top coat spray booth 21 will have a bottle bottom stabilizing conveyor 35 with bottle bottom dimple engageable pivot pins 36 in synchronized parallel alignment and registration with the bottle chucks 5 of the overhead chuck conveyor 4. The bottle bottom stabilizing conveyor 35 has an ascending track section 37, e.g., a rise in track elevation of about 1 inch, adjacent the entry to the prime coat spray booth 13 for bringing the pivot pins 36 into engagement with the bottle bottom dimples 38 centrally located in the bottoms of the bottles and has a descending track section 39, e.g., a fall in track elevation of about 1 inch, adjacent the exit from the second top coat spray booth 21 for bringing the pivot pins 36 out of engagement with the bottle bottom dimples 38. Each pivot pin 36 is spring-loaded by a spring 40 and has a notch 41 in its face and the descending track section 39 has an inclined overhead bar 42 in depression engagement with the notch 41 of each spring-loaded pivot pin 36 for depressing the pivot pins 36 away from the bottom bottle dimples 38. Each pivot pin 36 has snap-on snap-off means 43 for connecting it to a belt 44 of the bottle bottom stabilizng conveyor 35.

The improved process of the present invention comprises the modified step or operation of rotating and spray coating the suspended bottles at least once while engaging the bottle bottom dimples 38 with stabilizing pivot pins 36.

The front course of the bottom bottom stabilizing conveyor 35 is aligned directly beneath and parallel to the front course of the overhead chuck conveyor 4 at the prime coat spray booth 13, the prime coat dryer 16, the first top coat spray booth 18 and the second top coat spray booth 21. Thereat each pivot pin 36 is in registration with or directly beneath a corresponding bottle chuck 5. The pivot pins 36 are synchronized or run at the same linear speed as the bottle chucks 5, since the chain belt of the overhead chuck conveyor 4 and the chain belt 44 of the bottle bottom stabilizing conveyor 35 are driven by means of a single electrical motor 45 and have a common drive shaft 46 located at the rear or return courses of the two superimposed conveyors.

In order that the belt 44 of the bottle bottom stabilizing conveyor 35 can readily traverse the four horizontal curves 47 of the slotted track 48 as well as readily traverse the ascending track section 37 and the descending track section 39, the belt 44 consists of articulated units. One such unit or segment has two opposed rollers 49 rotatable in a horizontal plane about each end of a vertical axle 50 passing through the center of horizontal links 51. Such a unit or segment is adjoined to and alternates with an identical unit or segment having two opposed rollers 52 rotatable in a vertical plane and mounted at each end of a horizontal axle 53 passing through the center of vertical links 54. The horizontal links 51 are connected together at their ends by vertical rods 55 passing between vertical links 54 which are in turn connected together at their ends by horizontal rods 56 passing between horizontal links 51 so as to provide in effect a universal joint. The vertically rotatable rollers 52 ride along the bottom of the slotted track 48 while the horizontally rotatable rollers 49 ride along the walls of the slotted track 43, particularly at the curves 47.

The slotted track 48 of the bottle bottom stabilizing conveyor 35 is mounted upon vertically adjustable stanchions or supporting legs 57 and is provided with two opposed telescoping spring take-up sections 58 so that the track 48 and the floating belt 44 can ride horizontally upon rollers 59 which are moveable along horizontal channels 60 and thereby adjust the tension on the belt 44.

The overhead chuck conveyor 4 is preferably an inverted structural version of the bottle bottom stabilizing conveyor 35.

The rear or return course of the bottle bottom stabilizing conveyor 35 lies directly beneath and is in alignment with a portion of the rear or return course of the overhead chuck conveyor 4 in order that the single electric drive motor 45 with its operatively connected drive shaft 46 can drive synchroneously the belts of both of these two conveyors. The outer side walls of the two slotted tracks of the two conveyors are open opposite the motor 45 so that the common drive shaft 46 locked to upper and lower sprockets 61 can drive upper and lower drive chains 62 which are also carried around upper and lower idler sprockets 63 locked to a common idler shaft 64. The drive chains 62 have mounted thereon a plurality of spaced drive dogs 65 which grip vertical axles 50.

The vertical support pins 66 attached to vertical rods 55 have mounted thereon a horizontal support plate 67 which has a vertical central orifice 68. Within the orifice 68 there is mounted a stem 69 which fits within a cylindrical axial concavity 70 of a pivot pin 36. Extending upwardly from the cylindrical axial concavity 70 there is a smaller cylindrical axial concavity in the pivot pin 36 which is in alignment with a cylindrical axial concavity 72 within the upper portion of the stem 69. A coil spring 40 is housed within the cylindrical axial concavities 71 and 72 so as to spring-load the pivot pin 36.

The lower wall of the pivot pin 36 has a vertical guide slot 73. Within the guide slot 73 there is a guide screw 74 threaded into and attached to a threaded horizontal orifice 75 within the upper portion of the stem 69. By this arrangement the pivot pin 36 is depressible against the spring 40 and is guided along the stem 69 by guide screw 74 riding in the vertical guide slot 73.

The snap-on snap-off means 43 for connecting a pivot pin 36 to the belt 44 of the bottle bottom stabilizing conveyor 35 comprises a set screw 76 threaded into the front of the support plate 67 and intersecting the orifice 68. The set screw 76 has a cylindrical axial concavity 77 housing therein a ball 78 loaded by a spring 79. The ball 78 is held within the cylindrical axial concavity 77 by pinching or crimping the concavity at its open end so that less than a hemispherical portion of the ball 78 extends or protrudes outwardly from the concavity 77. The ball 78 of the spring-loaded set screw 76 engages an aligned concave recess 80 in the stem 69 within the orifice 68. A pivot pin 36 can be readily removed from the support plate 67 by gripping the pivot pin 36 and applying upward pressure against the spring-loaded ball 78 and hence any malfunctioning pivot pin 36 can be easily removed and replaced within a matter of seconds without having to stop the bottle bottom stabilizing conveyor 35.

In operation, a pivot pin 36 traveling along the ascending track section 37 of the bottle bottom stabilizing conveyor 35 comes into engagement with a bottom dimple 38 of a suspended bottle so as to act as a pivot point for that bottle and prevent bottle wobble as the bottle traverses along the horizontal portion of the bottle bottom stabilizing conveyor 35 within the prime coat spray booth 13, the prime coat dryer 16, the first top coat spray booth 18 and the second top coat spray booth 21, particularly when the bottle suspended by a bottle chuck 5 is spun or rotated by contact of the bottle chuck collar 9 with the drive belt 15, 20, 23 and 24 of the bottle rotators or spinners. Moreover, the bottles to be spray coated can travel at a greater linear speed without danger of their dropping from the bottle chucks caused by the rotational or centrifugal force imparted by the bottle rotators.

As the bottles carried by the overhead chucks 5 of the overhead chuck conveyor 4 leave the second top coat spray booth 21, the pivot pins 36 are brought out of engagement with the dimples 38 in the bottoms of the bottles due to the fact that the pivot pins 36 descend along the descending track section 39 of the track 48 of the bottle bottom stabilizing conveyor 35.

In order to prevent marring of the wet spray coat on the bottom of a bottle due to drag of the pivot pin 36 against the bottom of the bottle from the central dimple 38 to the edge of the bottle, the preferred embodiment of the improved system of the invention provides a pivot pin 36 loaded with a compressible spring 40 and having opposed inclined notches 41 which engage depression bars 42 mounted above the descending track section 39 of the bottom bottle stabilizing conveyor 35. Engagement of the inclined notches 41 with the compression bar 42 forces the pivot pin 36 downwardly against the compressible coil spring 40 so as to promptly bring the pivot pin 36 out of contact or engagement with the dimple 38 in the center of the bottle bottom.

The improved bottle coating system of the invention is capable of operating at an ultra high speed such that 90–100 bottles per minute or more can be spray coated without wobble of the suspended bottles during the spray coating operation. Bottle wobble is prevented and bottle breakage is substantially eliminated because the bottles during most of the period of their suspension from the overhead chucks 5 are stabilized or supported by the pivot pins 36.

In addition to the variations or embodiments of the improvement of the invention described above, other variations or embodiments are also possible. For example, instead of providing the bottle bottom stabilizing conveyor 35 with an ascending track section 37 and a descending track section 39, the entire track 48 could be horizontal and the overhead chuck conveyor 4 provided with descending and ascending track sections immediately above where the ascending and descending track sections 37 and 39, respectively, are eliminated. In such an arrangement the bottles carried by the overhead chuck conveyor 4 would then be lowered upon the pivot pins 36 at the descending track section of the so-modified overhead chuck conveyor 4 and would be lifted off the pivot pins 36 at the ascending track section of the so-modified overhead chuck conveyor 4.

It will be appreciated that other variations and embodiments of the improvement of the invention in addition to those discussed above can be made by those skilled in the art without departing from the essence of the improved invention and accordingly the improved invention is to be limited only within the scope of the appended claims.

What is claimed is:

1. An ultra high speed coating process for spray coating about 90 to 100 suspended bottles per minute without wobble of the suspended bottles during the spray coating operation and without appreciable bottle breakage, each of which bottles has a dimple centrally located in the bottom of the bottle, which comprises sequentially and synchronously:

(1) unpacking the bottles from cartons at a bottle unpacking station into upright multi-files and conveying and directing said multi-files of bottles into single file onto a first single file bottle belt conveyor, (2) conveying said single file of bottles in an upright position on said first single file bottle belt conveyor from said bottle unpacking station to a bottle loading station, (3) loading the upright bottles by their finish from said first single file bottle belt conveyor into bottle chucks carried by an aligned and synchronized overhead chuck conveyor at a bottle loading station, (4) engaging the bottle bottom dimples with engageable stabilizing pivot pins carried by a bottle bottom stabilizing conveyor, said pivot pins being in synchronized parallel alignment and registration with the bottle chucks, (5) rotating and spray coating the sides and bottoms of the upright bottles at least once while suspended vertically from said overhead chuck conveyor and stabilized by said bottle bottom stabilizing conveyor, both conveyors traveling through at least one bottle rotating and spray coat station, the bottles being spray coated at an ultra high speed of about 90 to 100 bottles per minute, (6) disengaging the stabilizing pivot pins from the bottle bottom dimples after the upright bottles exit from said at least one bottle rotating and spray coat station, (7) heat drying the bottoms of the coated bottles while suspended vertically from said overhead chuck conveyor traveling through a bottle bottom dryer, (8) unloading the coated bottles in single file upright position from said overhead chuck conveyor onto a second aligned and synchronized single file bottle belt conveyor at a bottle unloading station, (9) conveying the single file of upright coated bottles on said second single file bottle belt conveyor from said bottle unloading station to a multi-file bottle stacking station,

(10) stacking said upright coated bottles at said multi-file bottle stacking station from said second single file bottle belt conveyor into multi-files onto a conveyor belt passing through a curing oven,

(11) curing and cooling the multi-files of upright coated bottles while passing through a curing oven having heating and cooling sections, and

(12) packing the cured and cooled coated bottles into cartons at a bottle packing station.

2. An ultra high speed coating process for spray coating about 90 to 100 suspended bottles per minute without wobble of the suspended bottles during the spray coating operation and without appreciable bottle breakage, each of which bottles has a dimple centrally located in the bottom of the bottle, which comprises sequentially and synchronously:

(1) unpacking the bottles from cartons at a bottle unpacking station into upright multi-files and conveying and directing said multi-files of bottles into single file onto a first single file bottle belt conveyor, (2) conveying said single file of bottles in an upright position on said first single file bottle belt conveyor from said bottle unpacking station to a bottle loading station, (3) loading the upright bottles by their finish from said first single file bottle belt conveyor into bottle chucks carried by an aligned and synchronized overhead chuck conveyor at a bottle loading station, (4) engaging the bottle bottom dimples with engageable stabilizing pivot pins carried by a bottle bottom stabilizing conveyor, said pivot pins being in synchronized parallel alignment and registration with the bottle chucks, (5) rotating and spray prime coating the sides and bottoms of the upright bottles while suspended vertically from said overhead chuck conveyor and stabilized by said bottle bottom stabilizing conveyor, both conveyors traveling through a bottle rotating and prime coat spray booth, (6) drying the prime coated bottles suspended vertically from said overhead chuck conveyor and stabilized by said bottle bottom stabilizing conveyor, both conveyors traveling through a prime coat dryer, (7) rotating and spray top coating the sides and bottoms of the upright bottles while suspended vertically from said overhead chuck conveyor and stabilized by said bottle bottom stabilizing conveyor, both conveyors traveling through a first bottle rotating and top coat spray booth, (8) rotating and spray top coating the sides of the upright bottles while forwardly and reversely rotating the bottles suspended vertically from said overhead chuck conveyor and stabilized by said bottle bottom stabilizing conveyor, both conveyors traveling through a second bottle rotating and top coat spray booth, the bottles being spray coated at an ultra high speed of about 90 to 100 bottles per minute in spray coating steps (5), (7) and (8), (9) disengaging the stabilizing pivot pins from the the bottle bottom dimples after the upright bottles exit from said second bottle rotating and top coat spray booth,

(10) heat drying the bottoms of the coated bottles while suspended vertically from said overhead chuck conveyor traveling through a bottle bottom dryer,

(11) unloading the coated bottles in single file upright position from said overhead chuck conveyor onto a second aligned and synchronized single file bottle belt conveyor at a bottle unloading station,

(12) conveying the single file of upright coated bottles on said second single file bottle belt conveyor from said bottle unloading station to a multi-file bottle stacking station,

(13) stacking said upright coated bottles at said multi-file bottle stacking station from said second single file bottle belt conveyor into multi-files onto a conveyor belt passing through a curing oven,

(14) curing and cooling the multi-files of upright coated bottles while passing through a curing oven having heating and cooling sections, and

(15) packing the cured and cooled coated bottles into cartons at a bottle packing station.

* * * * *

UNITED STATES PATENT OFFICE

CERTIFICATE OF CORRECTION

Patent No. 4,098,932 Dated July 4, 1978

Inventor(s) Dale George Frische

It is certified that error appears in the above-identified patent and that said Letters Patent are hereby corrected as shown below:

Col. 1, line 57, "bottom" should read --bottle--.

Col. 2, line 15, "bottles" should read --bottle--; line 26, after "the" insert--two--; line 31, "throughout" should read --throughput--; line 51, "as" should read --an--.

Col. 5, line 47, "15-15" should read --15-5--; line 48, "convention" should read --convection--.

Col. 6, line 9, delete "will"; lines 29 and 30, "stabilizng" should read --stabilizing--.

Col. 7, line 2, "43" should read --48--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*